US009897957B2

(12) United States Patent
Son et al.

(10) Patent No.: US 9,897,957 B2
(45) Date of Patent: Feb. 20, 2018

(54) IMAGE FORMING APPARATUS AND COLOR TONE DENSITY CONTROLLING METHOD THEREOF

(71) Applicant: S-PRINTING SOLUTION CO., LTD., Suwon-si, Gyeonggi-do (KR)

(72) Inventors: Jung-woo Son, Seoul (CN); Suk-goo Kim, Namyangju-si (KR); Jeong-tae Kim, Incheon (CN)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 112 days.

(21) Appl. No.: 13/869,281

(22) Filed: Apr. 24, 2013

(65) Prior Publication Data

US 2013/0330095 A1 Dec. 12, 2013

(30) Foreign Application Priority Data

Jun. 8, 2012 (KR) ..... 10-2012-0061739

(51) Int. Cl.
*G03G 15/00* (2006.01)

(52) U.S. Cl.
CPC . *G03G 15/5041* (2013.01); *G03G 2215/0116* (2013.01)

(58) Field of Classification Search
CPC ..... G03G 15/5041; G03G 2215/0116
USPC ..... 399/49, 54, 72
See application file for complete search history.

(56) References Cited

U.S. PATENT DOCUMENTS

| | | | | |
|---|---|---|---|---|
| 5,991,580 | A * | 11/1999 | Byeon | 399/227 |
| 6,819,447 | B1 * | 11/2004 | Sawano | 358/1.16 |
| 2002/0186980 | A1 * | 12/2002 | Tsuruya | G03G 15/5058 399/49 |
| 2004/0057739 | A1 * | 3/2004 | Shimura | 399/49 |
| 2005/0135822 | A1 * | 6/2005 | Nakagawa | G03G 15/5062 399/49 |
| 2007/0230976 | A1 * | 10/2007 | Takahashi | 399/35 |
| 2008/0056752 | A1 * | 3/2008 | Denton | G03G 15/5062 399/74 |
| 2008/0218539 | A1 * | 9/2008 | Hill | B41J 3/407 347/7 |

* cited by examiner

*Primary Examiner* — Walter L Lindsay, Jr.
*Assistant Examiner* — Philip Marcus T Fadul
(74) *Attorney, Agent, or Firm* — Staas & Halsey LLP

(57) ABSTRACT

A method of controlling a color-tone density (CTD) of an image forming apparatus including a plurality of developers configured to circularly perform a developing operation. The method includes developing test patches on an OPC sequentially from a developer to be developable preferentially, measuring CTDs of the developed test patches, and controlling a development variable using the measure CTDs.

19 Claims, 9 Drawing Sheets

(a)

(b)

IMAGE FORMING APPARATUS AND COLOR TONE DENSITY CONTROLLING METHOD THEREOF

CROSS-REFERENCE TO RELATED APPLICATIONS

This application claims priority from Korean Patent Application No. 10-2012-0061739, filed on Jun. 8, 2012, in the Korean Intellectual Property Office, the disclosure of which is incorporated herein by reference in its entirety.

BACKGROUND OF THE INVENTION

1. Field of the Invention

Apparatuses and methods consistent with exemplary embodiments relate to an image forming apparatus and a color-tone density (CTD) controlling method thereof, and more particularly, to a multi-path type image forming apparatus and a CTD controlling method thereof.

2. Description of the Related Art

Image forming apparatuses are apparatuses which print printing data generated in a terminal apparatus, such as a computer, on a recording paper. As an example of the image forming apparatuses that perform such functions, there are copiers, scanners, facsimiles, or multiple function peripherals (MFPs) which multiply implement functions thereof through one apparatus.

In recent years, laser image forming apparatuses with remarkable effects in terms of printing quality, printing speed, noise in printing, and the like as compared with dot image forming apparatuses or inkjet image forming apparatuses which have mainly been used in the related art have been used increasingly. The laser image forming apparatuses are apparatuses using the principle which coats a toner to an organic photo conductor (OPC) using laser light ray modulated into a picture signal, transfers the toner coated on the OPC to a printing paper, and fixes the toner on the printing paper with high heat and pressure.

In particular, color laser image forming apparatuses which also implement color using a laser system have been increasingly used in recent years. In general, the color laser image forming apparatuses represent a color image using four color toners of cyan (C), magenta (M), yellow (Y), and black (K).

In the color laser image forming apparatuses, there are a single-path system including four laser scanning units and four OPCs and a multi-path system including one laser scanning unit and one OPC.

The time required in color printing and the time required in black and white printing are the same in the single-path system. Therefore, the single-path system is mainly used in high-speed color laser image forming apparatuses. However, since the high-speed color image forming apparatuses include the four laser scanning units and the four OPCs, the production cost becomes expensive. Thus, color laser image forming apparatuses which operate in a relatively low-speed range employ the multi-path system which includes one OPC and one laser scanning unit and repeatedly performs a writing operation, a developing operation, and a transferring operation for each color to form a color toner image on an intermediate transfer belt, and transfers and fixes the color toner image to a paper.

The CTD of an image formed by the color laser image forming apparatuses is changed due to various factors such as change in an environment such as a temperature or a humidity, temporal change in consumables including a developer, or change in voltages related to the development.

To uniformly maintain the CTD of the image, it is necessary to measure the CTD of the image periodically or at a specific point of time and appropriately control development variables according to the measured result.

The method of controlling a CTD of an image in the prior multi-path type color laser image forming apparatus will be described. The CTD of a test patch formed on an OPC or an intermediate transfer belt is measured using a CTD sensor. The measuring operation for each developer is repeatedly performed to repeatedly measure the CTD and then final development variables are determined.

However, when the test patch is developed on the OPC in the related art, the test patches for CMYK are developed in order of the Y, M, C and K test patches. That is, the test patches are developed as shown in FIG. 1. This is because the development operation which is performed in order of the Y, M, C, and K developers in a color printing job is applied to the test patch development operation.

When the test patches are developed in order of Y, M, C, and K developers as in the related art, an unnecessary operation is caused when the test patch is developed in association with the configuration of the image forming apparatus, and it takes a long time to measure the CTD of the test patch.

SUMMARY OF THE INVENTION

One or more exemplary embodiments may overcome the above disadvantages and other disadvantages not described above. However, it is understood that one or more exemplary embodiment are not limited to overcoming the disadvantages described above, and may be directed to other features and utilities of the general inventive concept.

One or more exemplary embodiments provide an image forming apparatus which develops a test patch on an OPC sequentially from a developer to be developable preferentially and a CTD controlling method thereof.

Additional features and utilities of the present general inventive concept will be set forth in part in the description which follows and, in part, will be obvious from the description, or may be learned by practice of the general inventive concept.

Exemplary embodiments of the present inventive concept provide a method of controlling a color-tone density of an image forming apparatus including a plurality of developers configured to circularly perform a developing operation. The method may include: developing test patches on an OPC sequentially from a developer to be developable preferentially; measuring CTDs of the developed test patches; and controlling a development variable using the measured CTDs.

The developer to be developable preferentially may be a black (K) developer.

The plurality of developers may perform the developing operation in order of a yellow (Y) developer, a magenta (M) developer, a cyan (C) developer, and a black (K) developer when a color printing job is performed and the plurality of developers may develop the test patches in order of test patterns of K, Y, M, and C developers when the test patches are developed.

The developing may include developing the test patches in all the plurality of developers on the OPC during one cycle in which the OPC is rotated once.

The measuring may include measuring the CTDs of the test patches formed on an intermediate transfer belt or the OPC using a CTD sensor.

The image forming apparatus may have a cam type or a rotary type.

The developing may include developing the test patches so that a distance between a K test patch and a Y test patch among distances between two test patches from among all the developed test patches is to be shortest when the image forming apparatus has the cam type.

The method may further include performing a printing job using the controlled-development variable.

The method may further include developing in order of color developers of the plurality of developers except a black (K) developer, and the K developer when a color printing job is performed.

According to another aspect of an exemplary embodiment, there is provided an image forming apparatus. The image forming apparatus may include: an organic photo conductor (OPC) configured to form an electrostatic latent image; a plurality of developers configured to develop test patches on the OPC; a color-tone density (CTD) measuring unit configured to measure a CTD of each of the developed test patches; and a control unit configured to control the plurality of developers so that the plurality of developers develop the test patches on the OPC sequentially from a developer to be developable preferentially and to control a development variable using the measured CTDs.

The developer to be developable preferentially may be a black (K) developer.

The plurality of developers may perform a developing operation in order of a yellow (Y) developer, a magenta (M) developer, a cyan (C) developer, and a black (K) developer when a color printing job is performed and the plurality of developers may develop the test patches in order of test patterns of K, Y, M, and C developers when the test patches are developed.

The control unit may control the plurality of developers so that the test patches in all the plurality of developers are developed on the OPC during one cycle in which the OPC is rotated once.

The CTD measuring unit may measure the CTDs of the test patches formed on an intermediate transfer belt or the OPC using a CTD sensor.

The image forming apparatus may have a cam type or a rotary type.

The control unit may control the plurality of developers to develop the test patches so that a distance between a K test patch and a Y test patch among distances between two test patches from among all the developed test patches is shortest when the image forming apparatus has the cam type.

The control unit may control the plurality of developers to develop in order of color developers of the plurality of developers except a black (K) developer, and the K developer when a color printing job is performed.

As described above, according to the various exemplary embodiments, developers develop test patches sequentially from a test patch in a developer to be developable preferentially on an OPC so that the time required to measure the CTD of the test patch can be reduced.

Additional aspects and advantages of the exemplary embodiments will be set forth in the detailed description, will be obvious from the detailed description, or may be learned by practicing the exemplary embodiments.

According to another aspect of an exemplary embodiment, there is provided a method of controlling a color-tone density (CTD) of an image forming apparatus including a plurality of developers configured sequentially to perform a developing operation, the method comprising: developing test patches on an organic photo conductor (OPC) sequentially based on a positioning of a developer position indicating member; measuring CTDs of the developed test patches; and controlling a development variable using the measure CTDs.

In an exemplary embodiment, the positioning of the developer position indicating member is a home position.

In another exemplary embodiment, the developer position indicating member is includes an indicator for each color developer and a cam system to operate each of the color developers individually based on the position of the cam system indicated by the indicators.

In still another exemplary embodiment, the sequential developing of the test patches is different from a sequential developing operation of a color image.

In yet another exemplary embodiment, the sequential developing of the test patches begins with a black (K) developer.

According to another aspect of an exemplary embodiment, there is provided an image forming apparatus, comprising: an organic photo conductor (OPC) configured to form an electrostatic latent image; a plurality of developers configured to separately develop a color image and test patches on the OPC; a color-tone density (CTD) measuring unit to measure a CTD of each of the developed test patches; and a control unit configured to control the plurality of developers so that the plurality of developers develop the test patches on the OPC sequentially in a different order than the developers develop a color image.

In an exemplary embodiment, the control unit controls the developers to develop the test patches sequentially from a developer to be developable preferentially and controls a development variable using the measured CTDs.

BRIEF DESCRIPTION OF THE DRAWINGS

The above and/or other features and utilities of the present general inventive concept will be more apparent by describing in detail exemplary embodiments, with reference to the accompanying drawings, in which.

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
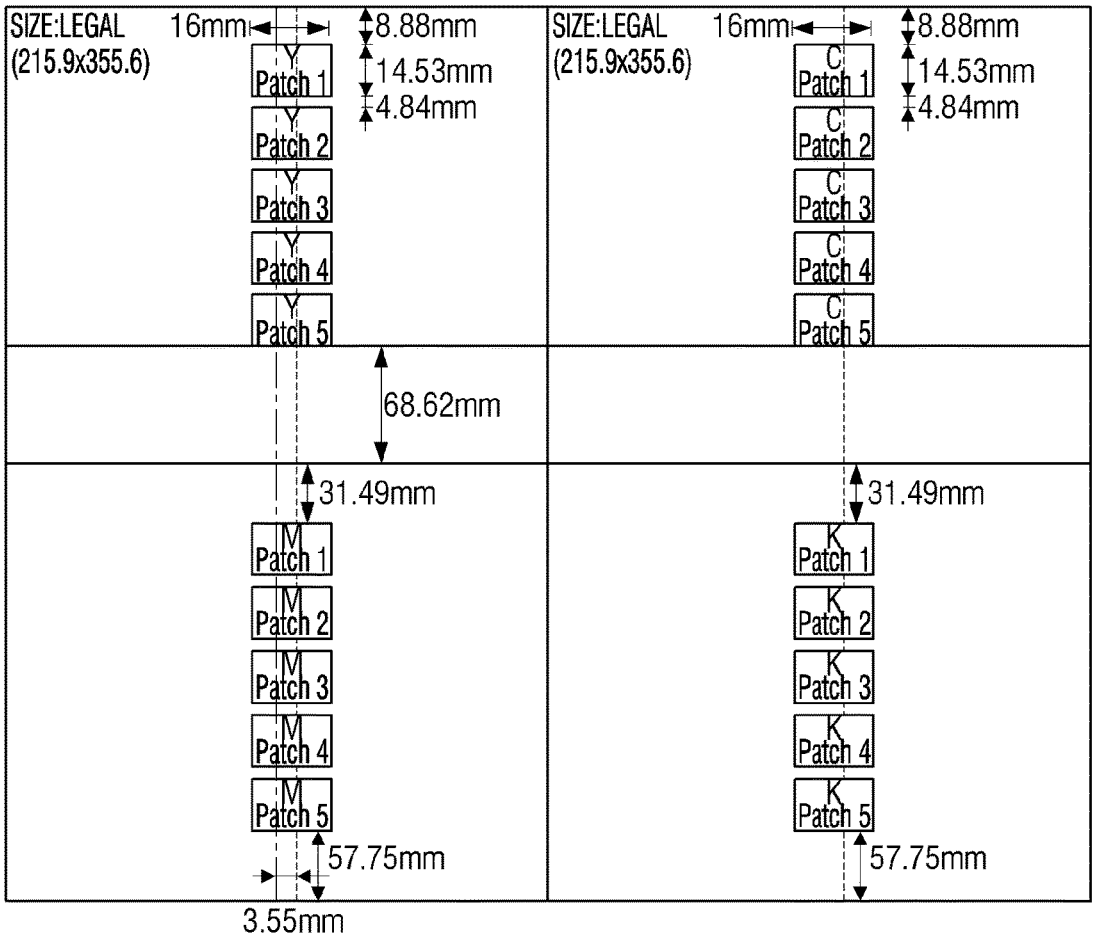
FIG. 1 is a view illustrating a test patch developed according to the related art.

Hereinafter, exemplary embodiments will be described in more detail with reference to the accompanying drawings.

In the following description, same reference numerals are used for the same elements when they are depicted in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, functions or elements known in the related art are not described in detail since they would obscure the exemplary embodiments with unnecessary detail.

Figure 2:
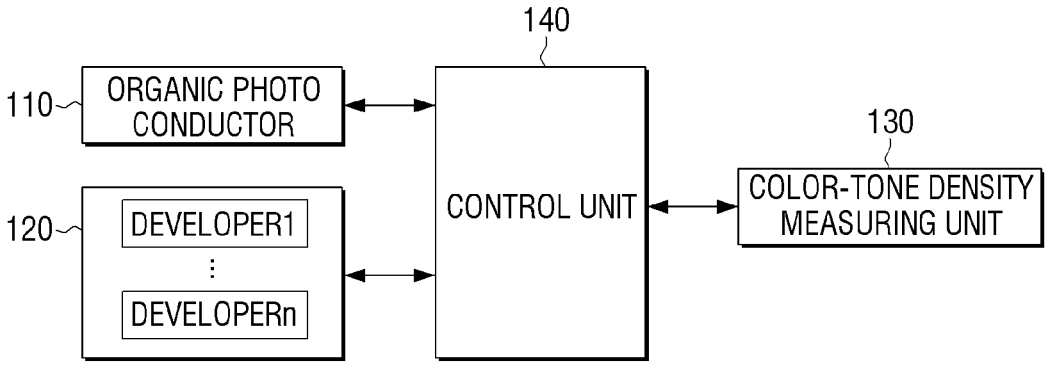
FIG. 2 is a block diagram illustrating an image forming apparatus according to an exemplary embodiment.

FIG. 2 is a block diagram illustrating an image forming apparatus according to an exemplary embodiment. Referring to FIG. 2, an image forming apparatus 100 partially or wholly includes an OPC 110, a plurality of developers 120, a CTD measuring unit 130, and a control unit 140. Here, the image forming apparatus may be a color laser image forming apparatus. Further, the image forming apparatus may have a multi-path system.

The multi-path system may include a cam type or a rotary type. The cam type or the rotary type will be described later in detail with reference to FIGS. 6 and 7.

An operation of the color laser image forming apparatus typically includes a processing procedure of charging, writing, developing, transferring, fusing, and the like, and the color laser image forming apparatus prints an image through the processing procedure. The charging process is a process of applying a high voltage (about 7000 V) to a charger, and causing negative (−) charges to be formed on a surface of the OPC by corona discharge. The writing process is a process of scanning a laser beam on the surface of the OPC, in which the negative (−) charges are formed, to dissipate the negative (−) charges in the form of letters so that a latent image is formed. The developing process is a process of causing toner particles having a negative (−) component to be attached on a portion of a surface of the OPC in which the latent image is formed. The transferring process is a process of applying a predetermined transfer voltage to the transfer when a paper passes between the OPC and the transfer to form positive (+) charges on a rear surface of the paper and pulling the negative (−) toner particles formed on the surface of a drum in a direction of a paper side. Next, the fusing process is a process of applying appropriate heat and pressure on the toner formed on the paper to be completely fused. An image is formed and output on the paper through all the processes. Hereinafter, the image forming apparatus according to an exemplary embodiment will be described in detail with reference to the above-described operation.

The OPC 110 is an area in which a printing image corresponding to printing data is formed by a laser beam before the printing data is printed on a printing paper P. A charging unit applies a charging current to the OPC to cause negative (−) charges to be charged on a surface of the OPC. A laser scanning unit (LSU) modulates the laser beam according to printing data to be printed and scans the modulated laser beam on the charged surface of the OPC 110. Therefore, an electrostatic latent image is formed on a written area of the surface of the OPC 110. In particular, an electrostatic latent image corresponding to a test patch may be formed on the OPC 110.

The plurality of developers 120 develop an image by providing toner particles to be attached onto the electronic latent image formed on the surface of the OPC 110. Here, the plurality of developers 120 may be implemented with four developers including Y, M, C, and K developers. Therefore, the plurality of developers 120 may develop an image with respective Y, M, C, and K toners.

The plurality of developers 120 may develop the test patches on the OPC 110 in which the electrostatic latent images corresponding to the test patches are formed.

The CTD measuring unit 130 may measure a CTD of the developed test patch. Here, the CTD measuring unit 130 may be implemented with a CTD sensor. Specifically, the CTD sensor may include a light-emitting unit configured to scan light on the test patch and a receiving unit configured to receive the light reflected from the test patch. In this case, the CTD sensor may convert an intensity of light input to the receiving unit according to the CTD of the test patch into an electrical signal to measure the CTD. Further, the CTD measuring unit 130 may measure the CTD of the test patch formed on an intermediate transfer belt or the OPC.

The control unit 140 controls an overall operation of the image forming apparatus 100. Specifically, the control unit 140 may partially or wholly control the OPC 110, the plurality of developers, and the CTD measuring unit 130.

In particular, the control unit 140 may control the plurality of developers so that the plurality of developers 121 perform a developing process in order of the Y, M, C, and K developers when a color printing job is performed. This is because when the developing order of the plurality of developers is changed, a color may be changed in a portion in multiple colors overlapping each other when the color printing job is performed.

Further, the control unit 140 may determine a point of time to measure the CTD. That is, the CTD of an image formed by the color laser image forming apparatuses is changed due to various factors such as a change in an environment such as a temperature or a humidity, temporal change in consumables including the developer, or a change in voltages related to the developing operation. To uniformly maintain the CTD of the image, it is necessary to measure the CTD of the image periodically or at a specific point of time and appropriately control a development variable according to the measured result. Thereby, the control unit 140 may determine a periodic point of time (for example, when 100 sheets of papers are printed) or a specific point of time (for example, when power is ON) as the point of time to measure the CTD.

Figure 4:
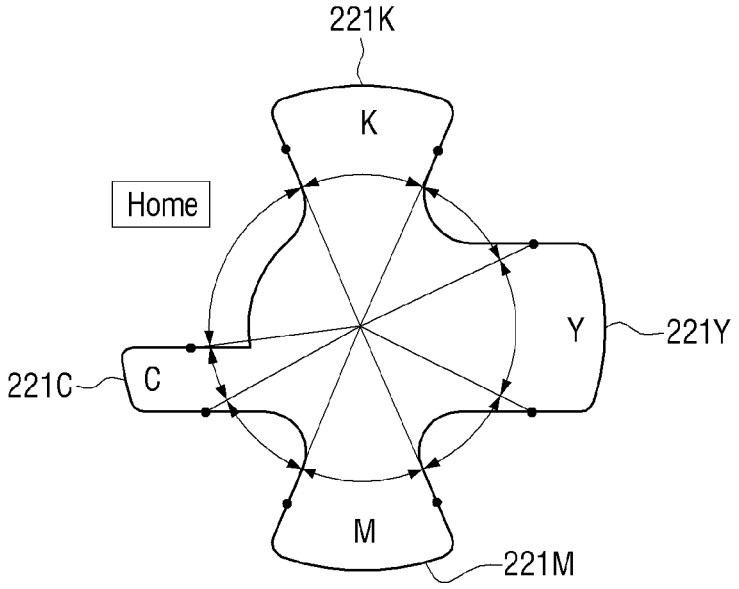
FIGS. 4A and 4B are a cross-sectional view and a perspective view illustrating an apparatus which circularly drives a plurality of developers in a cam type image forming apparatus.
Figure 4:
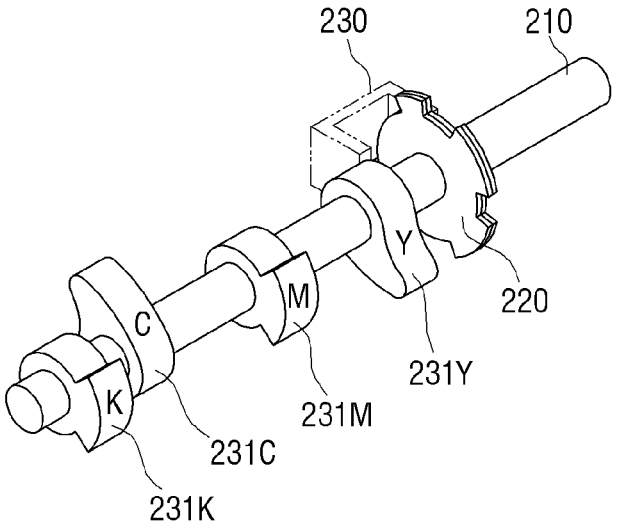

Further, when the control unit 140 determines the point of time to measure the CTD, first, the control unit 140 may control the plurality of developers 120 so that the plurality of developers develop test patches on the OPC 110 sequentially from a developer to be developable preferentially. The developer to be developable preferentially may be a K developer. Therefore, the control unit 140 may control the plurality of developers so that the test patches are developed in order of the K, Y, M, and C developers when the developing process on the test patch is performed. For clarity, the operation will be described in detail with reference to FIGS. 4 and 5.

Figure 5:
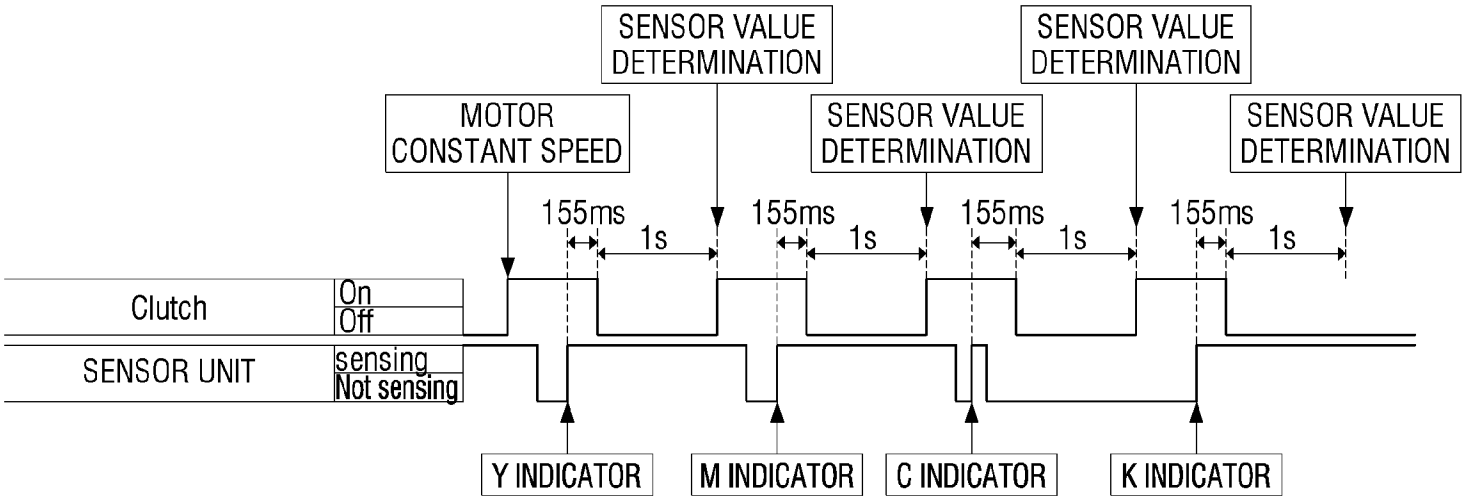
FIG. 5 is a graph showing an output of a sensor unit provided in an apparatus which circularly drives a plurality of developers in a cam type image forming apparatus.

FIGS. 4A and 4B are a cross-sectional view and a perspective view of an apparatus which circularly drives the plurality of developers in an image forming apparatus. FIG. 5 is a graph showing an output of a sensor unit provided in an apparatus which circularly drives the plurality of developers in the image forming apparatus. Referring to FIGS. 4A and 4B, the apparatus, which circularly drives the plurality of developers, include a cam shaft 210, a position indicating member 220, a sensor unit 230, and a plurality of cams 231K, 231Y, 231M, and 231K.

The position indicating member 220 may be provided to detect a home position of the cam shaft 210 and perform the developing operation. The position indicating member 220 may include a plurality of indicators 221K, 221Y, 221M, and 221C.

The plurality of indicators 221K, 221Y, 221M, and 221C may be disposed on an outer circumference of the position indicating member 120 to be spaced from each other at predetermined intervals. Here, the plurality of indicators 221K, 221Y, 221M, and 221C may correspond to respective developers to be driven. That is, a K indicator 221K is detected by the sensor unit 230, the K developer may be driven according to an operation of the cam 321K under control of the control unit 140. That is, when the cam shaft 210 is rotated, the plurality of cams 231Y, 231M, 231C, and 231K may sequentially drive the developers corresponding to respective four sliding hubs (not shown).

The sensor unit 230 may sense the plurality of indicators 221K, 221Y, 221M, and 221C to output sensed signals. In this case, the control unit 140 may detect the home position using the output sensed signals. Further, the control unit 140 may control operations of the plurality of developers using the output sensed signals.

Here, the sensor unit 230 may be an optical sensor. Specifically, as shown in FIG. 5, the position indicating member 220 is rotated by a clutch, the sensor unit 230 determines whether or not the plurality of indicators 221K, 221Y, 221M, and 221C are sensed after a constant period of time from a point of time when the plurality of indicators 221K, 221Y, 221M, and 221C are sense by rotation, and output sensed signals when the plurality of indicators 221K, 221Y, 221M, and 221C are sensed. When the plurality of indicators 221K, 221Y, 221M, and 221C are not sensed after the constant period of time, the sensed signals are not sensed. When the plurality of indicators 221K, 221Y, 221M, and 221C are not sensed after the constant period of time so that the sensed signals are not sensed, the control unit 140 may determine that a corresponding indicator is the C indicator. Thus, the control unit 140 may recognize the respective indicators. In this case, the control unit 140 may drive the clutch and rotate the position indicator member 220 to a home position. Here, the home position may be disposed between the C indicator and a black (K) indicator. This home position is illustrated to be at this location because this will provide the K developer to operate quickly in a black developing operation and while printing a job.

However, the method of sensing the home position is not limited to the above-described method. Various methods of sensing the home position may be used according to a shape of the position indicator member 220.

When a color printing job execution command is input in a state in which the position indicating member 220 is positioned at the home position as described above, the control unit 140 may control the plurality of developers to perform a developing operation in the order of the Y, M, C, and K developers. That is, the control unit 140 drives the clutch to rotate the position indicating member 220. In this case, the sensor unit 230 first senses the K indicator 231K positioned next to the home position and the control unit 140 passes the K indicator 221K and does not drive the K developer corresponding to the K indicator. Next, the sensor unit 230 senses the Y indicator positioned next to the K indicator 221K and the control unit 140 drives the Y developer corresponding to the Y indicator 221Y. In this case, the developed Y toner image may be first transferred on the intermediate transfer belt. Next, the sensor 230 senses the M indicator 221M, and the control unit 140 drives the M developer corresponding to the M indicator 221M. In this case, the developed M toner image may be first transferred on the intermediate transfer belt. Next, the sensor 230 senses the C indicator 221C and the control unit 140 devices the C developer corresponding to the C indicator 221C. In this case, the developed C toner image may be first transferred on the intermediate transfer belt. Next, the sensor 230 senses the K indicator 221K and the control unit 140 drives the black developer corresponding to the K indicator 221K. In this case, the developed K toner image may be first transferred on the intermediate transfer belt. Then, to cause the position indicating member 220 to be positioned at the home position, the control unit 140 may drive the clutch so that the position indicating member 220 passes through the Y, M, C, and K indicators 221Y, 221M, 221C, and 221K and is positioned at the home position.

However, the test patches used for CTD measurement are not in a color in which multi colors overlap each other, but are monochrome, and therefore it is not necessary to control the developers to perform a developing operation in order of the Y, M, C, and K developers.

Therefore, when the control unit 140 determines the point of time to measure the CTD, the control unit 140 may control the plurality of developers 120 to perform a developing operation in order of the K, Y, M and C developers. That is, the control unit 140 drives the clutch to rotate the position indicating member 220. In this case, the sensor 230 senses the K indicator 221K positioned next to the home position and the control unit 150 device the K developer corresponding to the K indicator 221K. Next, the sensor senses the Y indicator 221Y and the control unit 140 drives the Y developer corresponding to the Y indicator 221Y. Next, the sense 230 senses the M indicator 221M and the control unit 140 drives the M developer corresponding to the indicator 221M. Next, the sensor 230 senses the C indictor 221C and the control unit 140 drives the C developer corresponding to the C indicator 221C. When, the test patches are developed by the driving of the developers, the position indicating member 220 may be directly positioned at the home position.

That is, in the related art, the test patch developing operation is performed in the same order of the Y, M, C, and K developers as in the color printing job. Therefore, the rotation of the position indicating member 220 is further increased and the time required to measure the CTD is increased. Specifically, in a period in which the operation of the developer is unnecessary, since the unnecessary time, such as the time required for the K indicator 221K to pass the home position and the time required to pass for the Y, M, and C indicators to pass the home position after developing the test patch, is taken, the time required to measure the CTD is further increased.

However, according to the image forming apparatus of the exemplary embodiment, the test patches are developed on the OPC sequentially from the developer to be developable preferentially so that the time required to measure the OTD can be reduced.

Further, the control unit 140 may control the plurality of developers 120 so that the test patches of all the plurality of developers are developed on the OPC for 1 cycle in which the OPC is rotated once. That is, in the general multi-path type color image forming apparatus, one developer performs a developing operation on one color toner for 1 cycle in which the OPC is rotated once and the developed toner image is transferred on the intermediate transfer belt. Thus, the operation for the developers is repeatedly performed to form a color image. However, since the test patch is used not to print an image but to measure the CTD, the control unit 140 may control the plurality of developers 120 so that the test patches of the all the plurality of developers are developed on the OPC 110 for 1 cycle in which the OPC 110 is rotated once. In this case, the control unit 140 may control the charging unit, the laser scanning unit, and the plurality of developers 120 so that the test patches of the plurality of developers may be developed on the OPC 110 for 1 cycle in which the OPC is rotated once. Therefore, the image forming apparatus according to the exemplary embodiment enables the CTDs of four colors through only the developing operation for 1 cycle so that the time required to measure the CTD can be reduced.

In addition, since the image forming apparatus according to the exemplary embodiment has the cam type, the control unit 140 may control the plurality of developers so that a distance between the K test patch and the Y test patch among distances between all of the developed test patches is to be shortest. That is, referring to the cam type image forming apparatus illustrated in FIG. 1, the plurality of developers 120 are mounted so that the position of the developers is different according to colors. Thus, the time to write an image to the OPC 110 by the laser scanning unit and to develop a toner image on the OPC 110 using the developer 120 is different according to the colors. That is, the time required to write an image to the OPC 110 by the laser scanning unit and then to develop a toner image on the OPC 110 using the developing unit is different according to the toner color. That is, the time required to write an image related to the Y toner to the OPC by the laser scanning unit and to develop a Y toner image using the Y developer is longest, and the time required to write an image related to the K toner to the OPC 110 by the laser scanning unit and then to develop a K toner image using the K developer is shortest. Due to the mechanical structure, the time to perform the developing operation with a developer farthest from the laser scanning unit and then to perform the developing operation with a developer nearest to the laser scanning unit is shorter than the time to perform the developing operation with the developer nearest to the laser scanning unit and then to perform the developing operation with the developer farthest from the laser scanning unit, so that the image is formed faster in the former situation than in the latter situation. This is because since the K developer is disposed to be distant from the Y developer (see, for example, FIG. 6), the laser scanning unit forms an electrostatic latent image corresponding to the Y test patch on the OPC 110 immediately after forming an electrostatic latent image corresponding to the K test patch on the OPC 110.

Thereby, the control unit 140 may control the plurality of developers so that a distance between the K test patch and the Y test patch is shortest among distances between the Y test patch and the M test patch, the M test patch and the C test patch, and the C test patch and the K test patch.

As described above, according to the image forming apparatus of the exemplary embodiment, the test patches are formed in order of from the K test patch to the Y test patch so that the distance between the Y test patch and the K test patch can be minimized, and thus the time for CTD measurement can be reduced.

The control unit 140 may control the development variable using the measured CTD. The control unit 140 may perform the CTD measurement through the test patch development until a termination condition is satisfied. Here, the termination condition may include the number of the CTD measurement or a deviation between the measured CTD and a reference CTD which is smaller than a preset reference value. Therefore, when the termination condition is satisfied, the control unit 140 may control the development variable using the measured CTD. Here, the development variable may be a variable to perform the developing operation in the developer when the printing job is performed, for example, a CTD of a toner.

When the printing job is performed, the control unit 140 may control the plurality of developers 120 to perform the developing operation using the controlled-development variable.

Figure 3:
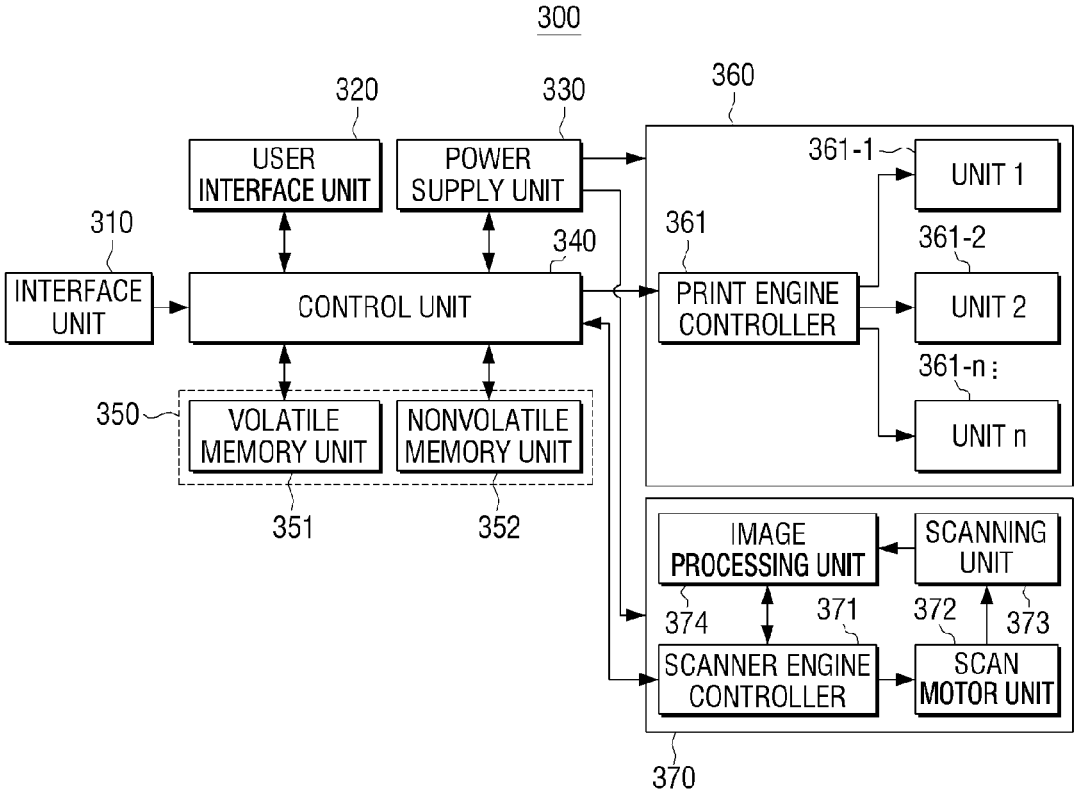
FIG. 3 is a detailed block diagram illustrating the image forming apparatus of FIG. 2.

FIG. 3 is a detailed block diagram illustrating the image forming apparatus of FIG. 2. Referring to FIG. 3, an image forming apparatus 300 includes an interface unit 310, a user interface unit 320, a power supply unit 330, a control unit 340, a storage unit 350, a printer unit 360, and a scanner unit 370. A description of each of components of the image forming apparatus 300 of FIG. 3 which are the same as those in the image forming apparatus 100 of FIG. 2 will be omitted. An MFP which performs at least two functions among those of a printer, a scanner, a copier, and a facsimile as illustrated in the configuration of FIG. 3. However, when the image forming apparatus 300 of FIG. 3 may have only a printer function, some components including the scanner unit 370 may be omitted. Although not shown, the image forming apparatus 300 may further include a bus configured to exchange data between the components and a buffer configured to temporarily store data, and the like.

The interface unit 310 may be connected to external devices locally or through a network so that the interface unit 310 receives data and commands from the external devices. That is, the interface unit 310 may be connected to a host personal computer (PC) through a local interface or connected to a network in a wired or wireless manner so that the interface unit 310 is connected to the plurality of external devices. As to the wireless communication standards, Institute of Electrical and Electronics Engineers (IEEE) 802.11 standards, hyper local area network (LAN) standards in Europe, MMAC-PC standards in Japan and the like may be used.

The user interface unit 320 receives various types of selection commands from the user. The user interface unit 320 may include a display panel and at least one button. In this case, the display panel may be implemented with a touch screen. The user interface unit 320 may provide various types of user interface (UI) screens and the user may input the selection command by directly touching the UI screen or operating the button included in the user interface unit 320. The selection command is a command to set various functions included in the image forming apparatus or to set a mode change, operation stop or operation restart.

The power supply unit 330 serves to supply power to respective components in the image forming apparatus. Specifically, the power supply unit 330 may receive commercial alternating current (AC) power (AC_IN) from an external source, convert the commercial AC power into direct current (DC) power having a potential level suitable for the respective components using a transformer, an inverter, a rectifier, and the like, and output the converted DC power (DC_OUT).

The control unit 340 controls the overall operation of the image forming apparatus according to data and commands of external devices connected through the interface unit 310 or the user's selection command input through the user interface unit 320. Further, the control unit 340 may perform the functions described in FIG. 2.

Specifically, when a printing command is executed in a printer driver installed in the host PC or an application, the printer driver of the host PC generates printing data in which a corresponding document is converted into a predetermined printing language. The control unit 340 receives the printing data through the interface unit 310, and may convert the printing data into a bitmap image configured of a plurality of "0s" and "1s" using a halftone table, and then provide the converted bitmap image to the printer unit 360 so that the corresponding document is printed on a paper.

The printer unit 360 may include a print engine controller 361 and a plurality of unit 362-1 to **362-*n*. Here, the OPC 110, the plurality of developers 120, and the CTD measuring unit 130 illustrated in FIG. 2 may be included in each of the plurality of units 362-1 to 362-*n* and the control unit 140 of FIG. 2 may perform a function of the print engine controller 361. When the printer unit 360 has a laser print type, each of the plurality of units 362-1 to 362-*n* may include a paper feeding unit, a charging unit, an OPC, a plurality of developers, a transferring unit, a fusing unit, a paper discharging unit, a CTD measuring unit, and the like. The print engine controller 361 controls each of the plurality of units 362-1 to 362-*n* and performs the printing job based on the bitmap image provided from the control unit 340**.

When a scan command is input through the user interface unit 320, the control unit 340 may control the scanner unit 370 to perform the scanning job.

The scanner unit 370 may include a scanner engine controller 371, a scanning unit 373, a scan motor unit 372, and an image processing unit 374.

The scanner engine controller 371 communicates with the control unit 340 and controls the respective components of the scanner unit 370 to perform the scanning job.

The scanning unit 373 serves to scan an object. The scanning unit 373 may be configured of an image scanning sensor, a lens, and a light source and as the image scanning sensor, a charge coupled device (CCD) or complementary metal oxide semiconductor (CMOS) image sensor (CIS) is mainly used. The image scanning sensor may include a photoelectric conversion unit configured to absorb reflection light of light generated from a light source and radiated to the object and to generate charges, a signal detection unit (not shown) configured to detect the charges generated from the photoelectric conversion unit and convert the charges into an electric signal, and the like. The electric signal converted in the signal detection unit is provided to the image processing unit 374.

The image processing unit 374 performs shading and gamma correction, dot per inch (DPI) conversion, edge emphasis, error diffusion, scaling, and the like on the image data input from the scanning unit 373 to generate scanning data. In this case, the image processing unit 374 appropriately performs the above-described processes by considering the preset resolution, a scan mode, a scan area, a reduction rate, and the like.

The scan motor unit 372 may move the scanning unit 373 or the paper to allow the whole object to be scanned. That is, the media moved by the scan motor unit 372 is different according to an operation type of the scanner, for example, a sheet feed type or a flat bed type. For example, the scan motor unit 372 moves the paper when the scanner is a sheet feed type scanner, while the scan motor unit 372 moves the scanning unit 373 wherein the scanner is a flat bed type scanner. The scan motor unit 372 may be implemented with a carriage return motor, and the like.

When the scan command is transmitted from the control unit 340, the scanner engine controller 371 drives the scanning unit 373 and the scan motor unit 372 to scan the object and controls the image processing unit 374 to cause the scan data to be generated.

The storage unit 350 is configured to store various information such as a specification of the image forming apparatus, a using state, printing data, scanning data, the processed data, and printing history information and various application programs and operating system (O/S) used in the image forming apparatus. The storage unit 350 may include a volatile memory unit 351 and a nonvolatile memory unit 352.

The volatile memory unit 351 may be used as a temporary storage space required to operate the image forming apparatus. That is, the volatile memory unit 351 may be implemented so that printing data transmitted from the host PC, free scanning data, data scanned for copying, and the like are temporarily stored in the volatile memory unit 351 and removed from the volatile memory unit 351 when the corresponding job is completed. Various types of data or programs may be permanently stored in the nonvolatile memory unit 352. It has been illustrated in FIG. 3 that one volatile memory and one nonvolatile memory are provided as the volatile memory unit 351 and the nonvolatile memory unit 352, but the number and sizes of the volatile memory and the non-volatile memory may be variously designed to be suitable for characteristics of the image forming apparatus.

Figure 6:
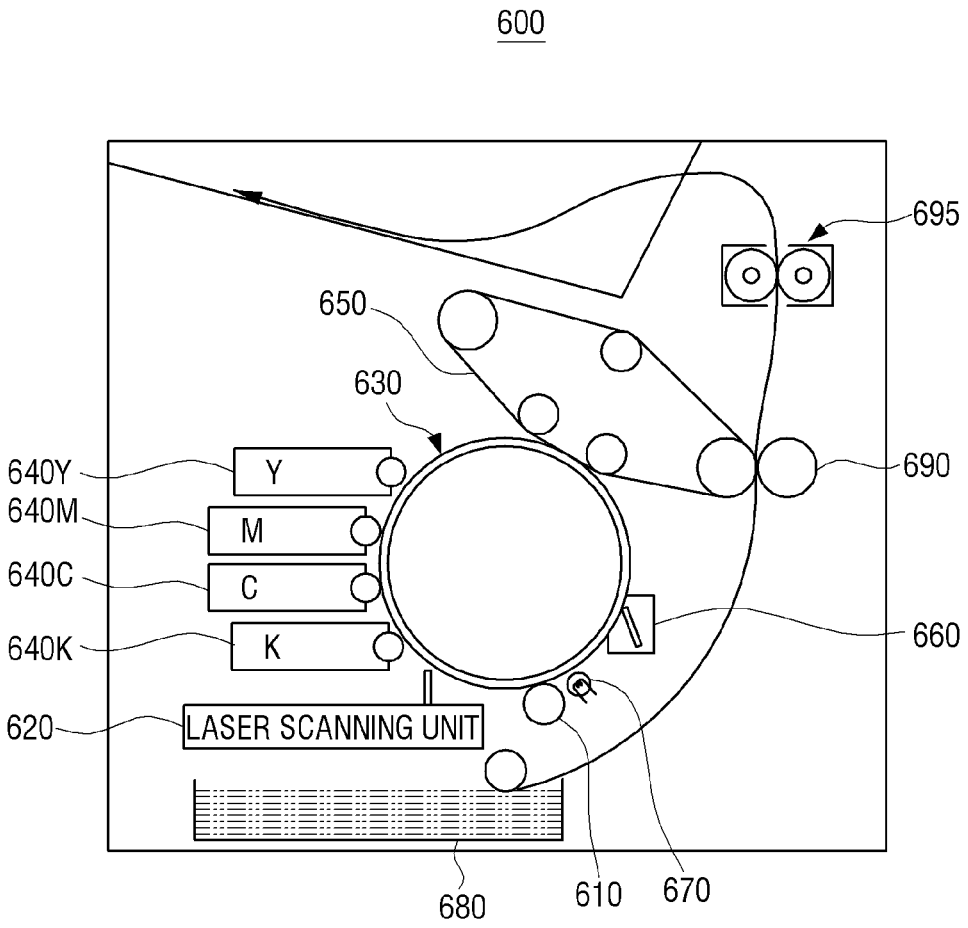
FIG. 6 is a view illustrating a cam type image forming apparatus according to an exemplary embodiment.

FIG. 6 is a view illustrating a cam type image forming apparatus according to an exemplary embodiment. Referring to FIG. 6, a cam type image forming apparatus 600 may partially or wholly include a charging roller 610, a laser scanning unit 620, four developers 640Y, 640M, 640C, and 640K, an intermediated transfer belt 650, a cleaning unit 660, and a discharging roller 670, which are disposed on an outer circumference of a rotating OPC 630 in a clockwise direction in FIG. 6, that is, a rotation direction of the OPC 630, a cassette 680 configured to feed a paper S, a transfer roller 690 configured to feed the paper S while allowing the paper P to be brought into contact with the intermediate transfer belt 650, and a fusing unit 695 configured to fix a toner image transferred on the paper S to the paper S.

The operation of performing a color printing job of the image forming apparatus having the above configuration will be described. Light corresponding to Y image information is scanned on the OPC 630 by the laser scanning unit 620 to form an electrostatic latent image. Then, a Y toner of the Y developer 640Y is attached to the electrostatic latent image so that a Y toner image is formed on the OPC 630, and the Y toner image is transferred to the intermediated transfer belt 650. When the formation of the Y toner image on the intermediate transfer belt 650 is completed, the laser scanning unit 620 scans light corresponding to M image information on the OPC 630 to form an electrostatic latent image. Then, an M toner contained in the developer 640M is attached to the electrostatic latent image to form an M toner image on the OPC 630, and the M toner image is transferred to the intermediate transfer belt 650. At this time, a scanning time of the light corresponding to the M image information scanned from the laser scanning unit 620 is controlled by considering a feeding speed of the intermediate transfer belt 650 so that a front end of the Y toner image which has been already formed on the intermediate transfer belt 650 is identical with a front end of the M toner image which starts to be transferred on the intermediate transfer belt 650 from the OPC 630. The above-described process is repeatedly performed on the C and K colors so that the Y, M, C, and K toner images are formed on the intermediate transfer belt 650 to overlap each other, and thus the overlapping toner images are transferred and fixed to the paper S to obtain a color image.

When the time to measure the CTD is determined, the control unit 140 controls the four developers 640Y, 640M, 640C, and 640K so that the test patches are developed in order of K, Y, M, and C test patches.

Figure 7:
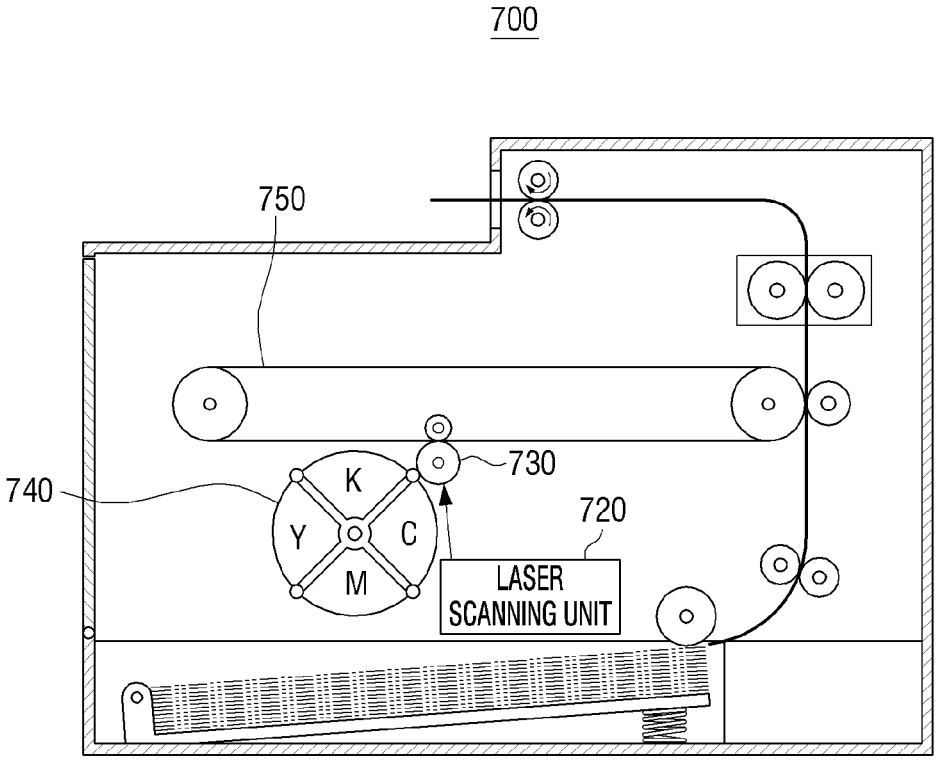
FIG. 7 is a view illustrating a rotary type image forming apparatus according to an exemplary embodiment.

FIG. 7 is a view illustrating a rotary type image forming apparatus according to an exemplary embodiment. Referring to FIG. 7, a rotary type image forming apparatus 700 includes an OPC 730, a laser scanning unit 720 configured to scan light to the OPC 730, an intermediate transfer belt 750 disposed to be adjacent to the OPC 730, and a rotating turret 740. Four developers 740Y, 740M, 740C, and 740K are disposed at an angle of 90° on the turret 740 so that the four developers 740Y, 740M, 740C, and 740K sequentially face the OPC 730 according to the rotation of the turret 740 by 90°.

The operation of performing a color printing job of the rotary type image forming apparatus having the above-described configuration will now be described. When the turret 740 is rotated so that the Y developer 740Y faces the OPC 730, the light corresponding to the Y image information is scanned to the OPC by the laser scanning unit 720 to form an electrostatic latent image on the OPC 730. Then, a Y toner contained in the Y developer 740Y is attached to the electrostatic latent image to form a Y toner image on the OPC 730, and the Y toner image is transferred to the intermediate transfer belt 750. When the formation of the Y toner image on the intermediate transfer belt 750 is completed, the turret 740 is rotated by 90° so that the M developer 740M faces the OPC 730, and the laser scanning unit 720 scans light corresponding to M image information to the OPC 730 to form an electrostatic latent image. Then, an M toner contained in the M developer 740M is attached to the electrostatic latent image to form an M toner image on the OPC 730, and the M toner image is transferred to the intermediated transfer belt 750. At this time, the scanning time of the light corresponding to the M image information scanned from the scanning unit 720 is controlled by considering a feeding speed of the intermediate transfer belt 750 so that a front end of the Y toner image which has been already formed on the intermediate transfer belt 750 is accurately identical with a front end of the M toner image which starts to be transferred on the intermediate transfer belt 750 from the OPC 730. When the above-described process is repeatedly performed on the C and K colors so that the Y, M, C, and K toner images are formed on the intermediate transfer belt 750 to overlap each other, the overlapping toner images are transferred and fixed to the paper S so that a color image can be obtained.

In the rotary type image forming apparatus described above, the home position may be disposed between the K developer 740K and the C developer 740C as shown in FIG. 7. By disposing the home position between the K and C developers allows for the K developer to operate in a short time period in a black and while printing job.

In the related art, the test patches for measuring the CTDs are developed in the same order of the Y, M, C, and K developers as in performing the color printing job and the K developer 740K, next to the home position, is passed by the turret 740. Then, the Y, M, C, and K developers 740Y, 740M, 740C, and 740K perform the developing operations, and then the turret 740 is rotated in an reverse direction to return the K developer 740K to the home position. Therefore, in the related image forming apparatus, even in the period in which the developer is not operated, unnecessary time, for example, the time required for the K developer to pass the home position and the time required for the K developer to rotate to return to the home position are required so that the time for measuring the CTD is increased.

However, the image forming apparatus of the exemplary embodiment controls the rotation of the turret 740 to develop the test patches so that the developers perform the developing operation sequentially from the K developer next to the home position so that the time required to measure the CTD can be reduced.

Figure 8:
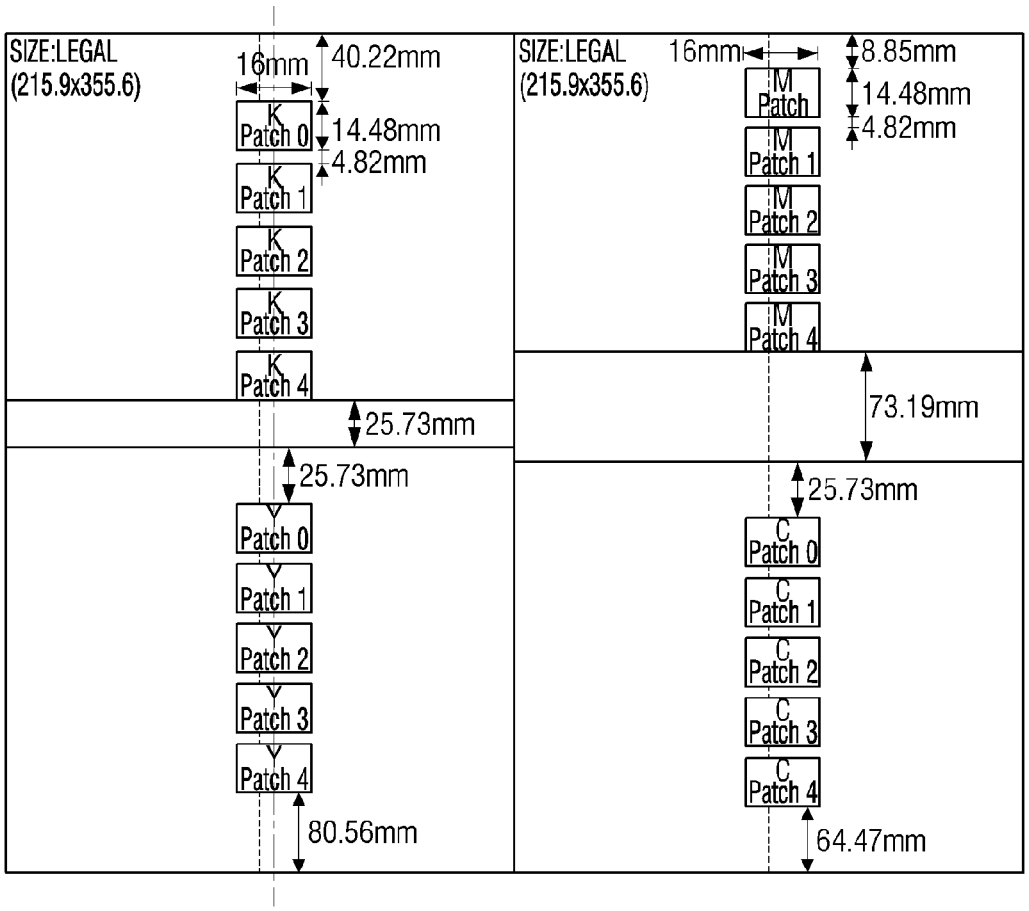
FIG. 8 is a view illustrating a test patch developed according to an exemplary embodiment.

FIG. 8 is a view illustrating a test patch development sequence according to an exemplary embodiment. Referring to FIG. 8, it can be seen that the image forming apparatus according to the exemplary embodiment develops the test patches in order of the K, Y, M, and C developers. That is, when the test patches are developed in order of the K, Y, M, and C developers as shown in FIG. 8, the unnecessary operation is excluded as described above so that the time required to measure the CTD can be reduced.

Further, as compared with FIGS. 1 and 8, a distance from a first test patch of the Y test patch group to the last test patch of the K test patch group in FIG. 1 is longer than a distance from a first test patch of the K test patch group to the last test patch of the C test patch group of FIG. 8. This is because the test patches are developed in order of the K, Y, M, and C developers so that the distance between the K test patch and the Y test patch can be minimized. Therefore, the image forming apparatus of the exemplary embodiment can further reduce the time required to measure the CTD.

Figure 9:
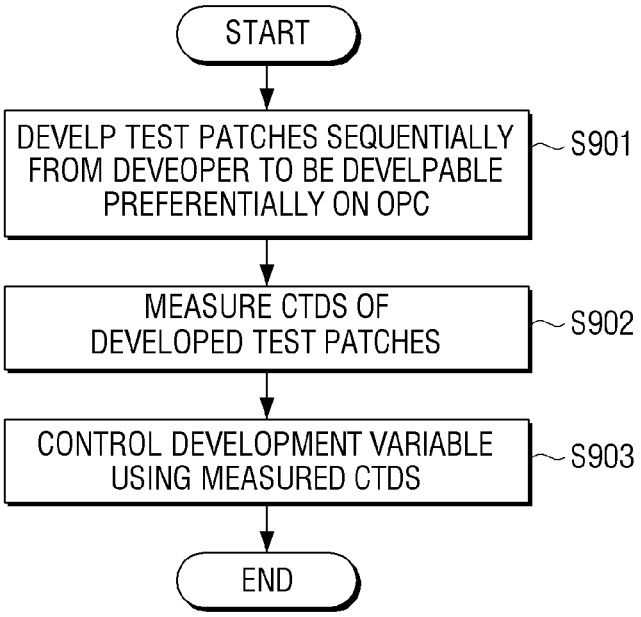
FIG. 9 is a flowchart illustrating a method of measuring a CTD according to exemplary embodiments.

FIG. 9 is a flowchart illustrating a method of measuring a CTD according to an exemplary embodiment. Referring to FIG. 9, first, test patches are developed on an OPC sequentially from a developer to be developable preferentially (operation S901). Then, CTDs of the developed test patches are measured (operation S902). A development variable is controlled using the measured CTDs (operation S903).

Here, the developer to be developed preferentially may be a K developer.

That is, the plurality of developers may perform the developing operation in order of the Y, M, C, and K developers in the color printing job and the plurality of developers may perform the developing operation in order of the K, Y, M, and C developers.

In operation S901, all of the plurality of test patches in the plurality of developers may be developed on the OPC for 1 cycle in which the OPC is rotated once.

In operation S902, CTDs of the test patches formed on an intermediate transfer belt or the OPC may be measured using the CTD sensor.

Here, the image forming apparatus may have a cam type or a rotary type.

Further, in operation S901, when the image forming apparatus has the cam type, the plurality of developers may perform the development so that a distance between the K test patch and the Y test patch is shortest among distances of any two test patches included in all the test patches.

The method of measuring a CTD of the exemplary embodiment may further include performing a printing job using the controlled-development variable.

The foregoing exemplary embodiments and advantages are merely exemplary and are not to be construed as limiting the present inventive concept. The exemplary embodiments can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A method of controlling a color-tone density (CTD) of a multi-path type image forming apparatus having an organic photoconductor (OPC) and including a plurality of developers, the method comprising:

determining whether a multicolor image to be printed on a paper or a plurality of monochrome test patches is to be developed on the OPC, the multicolor image being an image in which at least two monochrome images of different colors overlap with each other;

developing the multicolor image or the plurality of monochrome test patches on the OPC based on the determining; and if the plurality of monochrome test patches are developed, measuring the CTD of the developed plurality of monochrome test patches, and controlling a development variable using the measured CTDs, wherein the plurality of developers perform the developing on the OPC according to a first order if the multicolor image is determined to be developed, and the plurality of developers perform the developing on the OPC according to a second order that is different from the first order if the plurality of monochrome test patches are determined to be developed.

2. The method of claim 1, wherein the second order is an order in which, among the plurality of developers, a black (K) developer is an initial developer to develop one of the plurality of monochrome test patches.

3. The method of claim 1, wherein:

the first order is an order in which the plurality of developers performs the developing in order of a yellow (Y) developer, a magenta (M) developer, a cyan (C) developer, and a black (K) developer, and the second order is an order in which the plurality of developers perform the developing in order of K, Y, M, and C developers.

4. The method of claim 3, wherein the multi-path type image forming apparatus is a cam type or a rotary type.

5. The method of claim 4, wherein the plurality of developers develop the plurality of monochrome test patches so that a distance between a K test patch and a Y test patch is shorter than a distance between any two other of the developed plurality of monochrome test patches when the multi-path type image forming apparatus is the cam type.

6. The method of claim 1, wherein the plurality of developers develop all of the plurality of monochrome test patches on the OPC within one cycle in which the OPC is rotated once.

7. The method of claim 1, wherein the measuring includes measuring the CTDs of the plurality of monochrome test patches formed on an intermediate transfer belt or the OPC using a CTD sensor.

8. The method of claim 1, further comprising:

performing a printing job using the controlled development variable.

9. The method of claim 1, wherein the first order is an order in which, among the plurality of the developers, any developer except a black (K) developer is an initial developer to develop the multicolor image to be printed.

10. A multi-path type image forming apparatus, comprising:

an organic photo conductor (OPC);

a plurality of developers configured to develop a multicolor image to be printed on a paper and a plurality of monochrome test patches on the OPC, the multicolor image being an image in which at least two monochrome images of different colors overlap with each other;

a control unit configured to determine whether the multicolor image or the plurality of monochrome test patches is to be developed, and if the multicolor image to be printed is determined as being developed, to control the plurality of developers to perform developing on the OPC according to a first order, and if the plurality of monochrome test patches are determined to be developed, to control the plurality of developers to perform developing on the OPC according to a second order that is different from the first order; and a color-tone density (CTD) sensor configured to measure a CTD of each of the developed plurality of monochrome test patches.

11. The multi-path type image forming apparatus of claim 10, wherein the second order is an order in which, among the plurality of developers, a black (K) developer is an initial developer to develop one of the plurality of monochrome test patches.

12. The multi-path type image forming apparatus of claim 11, wherein the first order is an order in which, among the plurality of developers, any developer except a black (K) developer is an initial developer to develop the multicolor image to be printed.

13. The multi-path type image forming apparatus of claim 10, wherein the first order is an order in which the plurality of developers performs the developing in order of a yellow (Y) developer, a magenta (M) developer, a cyan (C) developer, and a black (K) developer, and the second order is an order in which the plurality of developers perform the developing in order of test patterns of K, Y, M, and C developers.

14. The multi-path type image forming apparatus of claim 13, wherein the image forming apparatus is a cam type or a rotary type.

15. The multi-path type image forming apparatus of claim 14, wherein the control unit controls the plurality of developers to develop the plurality of monochrome test patches so that a distance between a K test patch and a Y test patch is shorter than a distance between any two other of the developed plurality of monochrome test patches when the multi-path type image forming apparatus is the cam type.

16. The multi-path type image forming apparatus of claim 10, wherein the control unit controls the plurality of developers to develop all of the plurality of monochrome test patches on the OPC within one cycle in which the OPC is rotated once.

17. The multi-path type image forming apparatus of claim 10, wherein the CTD sensor measures the CTDs of the monochrome test patches formed on an intermediate transfer belt or the OPC.

18. The multi-path type image forming apparatus of claim 10, wherein the control unit controls a development variable using the measured CTDs.

19. A multi-path type image forming apparatus, comprising:

an organic photo conductor (OPC);

a plurality of developers;

a position indicating member which is provided at a camshaft and has a plurality of indicators corresponding to the plurality of developers;

a sensor unit configured to detect the plurality of indicators passing through the sensor unit; and a control unit configured to:

control the camshaft to start rotating, control the plurality of developers to develop test patches on the OPC sequentially from a developer corresponding to an indicator detected first by the sensor unit since the camshaft starts rotating, and measure a color-tone density (CTD) of each of the developed test patches, wherein among the plurality of developers, a black (K) developer is the first to develop one of the test patches.

* * * * *